US007735249B2

(12) United States Patent
Muller

(10) Patent No.: US 7,735,249 B2
(45) Date of Patent: Jun. 15, 2010

(54) QUICK-CHANGE DEVICE

(75) Inventor: Peter Muller, Niederroedern (FR)

(73) Assignee: Lehnhoff Hartstahl GmbH & Co. KG, Baden-Baden (DE)

( * ) Notice: Subject to any disclaimer, the term of this patent is extended or adjusted under 35 U.S.C. 154(b) by 0 days.

(21) Appl. No.: 12/299,613

(22) PCT Filed: May 16, 2007

(86) PCT No.: PCT/EP2007/004414

§ 371 (c)(1),
(2), (4) Date: Apr. 12, 2009

(87) PCT Pub. No.: WO2007/131800

PCT Pub. Date: Nov. 22, 2007

(65) Prior Publication Data

US 2009/0235561 A1 Sep. 24, 2009

(30) Foreign Application Priority Data

May 17, 2006 (DE) ..... 10 2006 023 420

(51) Int. Cl.
*E02F 3/96* (2006.01)

(52) U.S. Cl. ..... 37/468; 414/723

(58) Field of Classification Search ..... 37/466, 37/468, 403–409; 172/272–275; 414/694, 414/723, 729, 685, 703; 403/231, 322.1, 403/325, 328, 330, 321
See application file for complete search history.

(56) References Cited

U.S. PATENT DOCUMENTS 4,938,651 A * 7/1990 Gilmor et al. ..... 414/694
6,428,265 B1 8/2002 Gilmore, Jr.
7,032,335 B2 * 4/2006 Short ..... 37/468
7,246,457 B2 * 7/2007 Mieger et al. ..... 37/468
7,306,395 B2 * 12/2007 Fatemi ..... 403/321
7,648,305 B2 * 1/2010 Beales ..... 403/322.1

FOREIGN PATENT DOCUMENTS

| | | |
|---|---|---|
| DE | 102004014824 | 10/2005 |
| EP | 1566489 | 8/2005 |
| EP | 1580330 | 9/2005 |
| EP | 2007/004414 ISR | 8/2007 |
| FR | 2676765 | 11/1992 |
| WO | 2004/072387 | 8/2004 |

* cited by examiner

*Primary Examiner*—Robert E Pezzuto
(74) *Attorney, Agent, or Firm*—Woodling, Krost and Rust

(57) ABSTRACT

Quick-change device (12) comprising a quick coupler (16) fastened on the driven-machine side, an adapter (16) which can be locked with the quick coupler (16) and is connected to a tool (14), and a hydraulic coupling (20) for producing a hydraulic connection between the hydraulic system on the driven machine and the hydraulics of the tool (14), wherein the hydraulic coupling (20) includes a first coupling part (20*a*) and a second coupling part (20*b*) and the two coupling parts (20*a*, 20*b*) are held relative to one another in an operating position, wherein the first coupling part (20*a*) and the second coupling part (20*b*) interact with at least mechanical retaining means (68,78,80) which are formed separately from the locking means of the quick-change device (12). The invention is distinguished by the fact that the coupling parts (20*a*, 20*b*) are held frictionally in the operating position by the mechanical retaining means (67,78, 80).

25 Claims, 5 Drawing Sheets

QUICK-CHANGE DEVICE

Applicant claims priority to German patent application DE 10 2006 023 420.0 filed May 17, 2006.

FIELD OF THE INVENTION

The present invention pertains to a quick-change device.

BACKGROUND OF THE INVENTION

Many different embodiments of this type of quick-change device have become known.

A first embodiment of a quick-change device is known from, for example, EP 0 483 232 B1 and consists of a quick changer, comprising a pivoting and locking device, and an adapter. The quick changer is assigned to the arm of the excavator, and the opposing adapter, which is to be connected to the quick changer, is mounted on an exchangeable tool such as a sorting bucket.

The pivoting and locking device described in the publication cited above locks the adapter and the quick changer together, but it also brings the hydraulic couplings for the hydraulic fluid together. To bring these hydraulic couplings together, they must be pivoted over a relatively long distance. As a result of the spreading forces which occur during operation, the hydraulic couplings can leak and ultimately fail. This can also lead to considerable environmental damage.

A quick-change device is also known from WO 2005/093172 A1, which executes a pivoting movement to connect the quick changer to the adapter and also to connect the two coupling blocks together. The coupling blocks are mounted on the free end opposite the pivot axis, and one of the coupling blocks is supported in a floating manner. To counteract the spreading forces, a device is provided which generates hydraulic pressure on the hydraulic coupling in such a way that the coupling can resist the spreading forces. The force acts essentially in a direction perpendicular to the contact surfaces between the coupling blocks. Relative movements based on the elasticity of the selected material or on the basis of the floating support are thus avoided. In addition, a reliable hydraulic connection is guaranteed during operation.

The problem with this design, however, is that, in certain types of applications, the hydraulic pressures are very high, and these therefore cause very high spreading forces. Considerable effort is therefore required to counteract these spreading forces by means of a hydraulically produced pressure.

A quick-change device of the general type in question is also known from DE 101 59 417 A1. Here the coupling blocks of the hydraulic coupling are held positively in position by hooks, which are supported on one of the coupling blocks and which engage with a pin on the other coupling block when in the operating position.

It has been found, however, that, when the spreading forces are very high, either the mechanical means undergo fatigue and break or the material creeps, which causes the mechanical means to jam. As a result, the hydraulic coupling can no longer be disconnected, and, depending on the embodiment, the quick changer is also blocked.

SUMMARY OF THE INVENTION

According to one aspect of the invention, therefore, the invention is based on the task of elaborating a quick-change device in such a way that, while avoiding the disadvantages cited above, it is possible with simple means to counteract the spreading forces which occur during the coupling process and during operation, so that it is guaranteed that the hydraulic coupling can be disconnected when needed regardless of the circumstances.

The invention is based on the realization that, by the use of nonpositively connected retaining means, which go into action when the hydraulic coupling is connected, it is possible for most of the spreading forces to be absorbed, while at the same time it is also remains possible, if necessary, to disconnect the mechanical means by separating the nonpositive connection. Even if the material creeps under the high mechanical forces which occur during operation, it is still possible to disconnect the retaining means by separating the nonpositive connection. This can be optimized even more by certain design measures.

According to the invention, therefore, the hydraulic coupling parts, when in the operating position, are held together nonpositively by the mechanical retaining means. As a result, the above-described disadvantages are avoided, and additional design possibilities are obtained, as will be demonstrated in the following.

According to one embodiment of the invention, a drive unit is able to move at least parts of the mechanical retaining means from a change position to the operating position and/or from the operating position to the change position. This is advantageous especially from the standpoint of the ease of operation of the quick-change device.

The drive unit for moving the mechanical retaining means from the change position to the operating position and/or from the operating position to the change position is designed as a hydraulic, pneumatic, electrical, mechanical, and/or magnetic drive. As a result, a wide field of application is obtained for the quick-change device according to the invention.

The first coupling part can be designed as a coupling block connected to the quick changer, and the second coupling part can be designed as a coupling block connected to the adapter, where each of the coupling blocks comprises at least one part of a hydraulic coupling valve cooperating with the other part of the valve on the other block. The coupling blocks offer the advantage that the mechanical retaining means thus act simply on the coupling blocks and/or that these means can be integrated into the coupling blocks.

So that the hydraulic coupling can be kept operationally reliable even under very high spreading forces, it is advantageous, when the hydraulic coupling is in the operating position, for a mechanical drive to generate an opposing force acting on the coupling parts—see WO 2005/093172 A1—to provide additional opposition to the spreading forces and to relieve the load on the mechanical retaining means. Especially from the standpoint of saving space and simplifying the design, the mechanical drive which produces the opposing force is the same as the drive unit which moves the mechanical retaining means between the change position and the operating position.

Alternatively, the drive unit which moves the mechanical retaining means from the change position to the operating position can be the same, whereas the drive unit which moves the mechanical means from the operating position to the change position is formed by some other type of drive, in particular by a force-storing device such as a spring.

According to one embodiment of the invention, the drive unit which moves the mechanical retaining means from the change position to the operating position is designed as a fluidic, especially a hydraulic, drive with a single-acting piston. Alternatively, the drive unit which moves the mechanical retaining means from the change position to the operating position and from the operating position to the change position can be designed as a fluidic, especially a hydraulic, drive with a double-acting piston. The mechanical retaining means can in this case be easily moved by the hydraulic system already present on the working machine. This means that the lines can be easily connected, but it also makes it possible to retrofit existing working machines with a quick-change device according to the invention with little effort.

The mechanical retaining means comprise in particular a first part, which is connected to the quick changer, and a second part, which is connected to the adapter. The first part is preferably designed as a pin, and the second part is designed as a receptacle for the pin. The nonpositive connection is achieved primarily by the fact that the forward end of the bar tapers down in wedge-like fashion, and that the receptacle is given a corresponding shape. In addition, a force acting in the direction toward the operating position also acts on the pin. This force can be produced by the drive unit which moves the mechanical retaining means from the change position to the operating position and/or vice versa. Alternatively or in addition, this force can also be produced by a force-storing device, which could be activated under certain conditions.

To simplify the fabrication of the pin, it is designed as a cylindrical bolt with a conical shape in its forward area.

Jamming even at high pressures can be easily avoided by providing a bearing play S, which is present in the operating position underneath the locking pin and which extends as far as the inside surface of the receptacle. The bearing play S guarantees that the locking pins will always have a certain degree of freedom of movement in the downward direction and thus can also be disconnected even under difficult conditions.

According to one embodiment of the invention, allowance is made for manufacturing tolerances and wear by designing the lateral surface of the forward area of the locking pin and the associated surface of the receptacle as corresponding conical surfaces extending over a circumferential angle of up to 180°, where the steep circumferential surfaces of the receptacle which make up the rest of the circumference to 360° cooperate with the assigned circumferential surface areas of the forward area of the pin to enclose the predetermined bearing play S. Upon the occurrence of wear, the pressure-actuated locking pin will always be able to move farther forward, and reliable retention and surface-to-surface contact remain guaranteed.

Alternatively, one part of the mechanical retaining means can be designed as a rocker with a locking claw, and the other part of the mechanical means can be designed as an abutment, both the claw and the abutment being wedge-shaped.

In particular, the movement of the mechanical retaining means from the change position to the pivoted position and vice versa is linear. This makes a simple design possible.

The quick changer can be designed to pivot around a pivot axis and can comprise at least one locking bar, the line of movement of which cooperates with the pivot axis to form a working plane.

The locking bar is then preferably able to move along a first straight line in a direction perpendicular to the pivot axis, and the coupling movement of the hydraulic coupling proceeds along a second straight line, essentially perpendicular to the first straight line.

To facilitate a compact design, the second line is perpendicular to the pivot axis.

According to one embodiment of the invention, the pin moves from the change position to the operating position along a third straight line.

The third straight line can lie in the working plane; in particular, it can be perpendicular to the first and second straight lines and especially it can be parallel to the pivot axis.

According to another aspect, the invention is based on the task of elaborating a quick-change device in such a way that, while avoiding by simple means the disadvantages cited above, a compact design is obtained and the spreading forces which occur during the coupling step and in operation are counteracted in a simple manner.

The invention is based on the realization that, by designing the mechanical means for securing the hydraulic coupling in such a way that their movements are linear, a compact but efficient device is made possible.

According to the invention, therefore, the movements of the mechanical means from the change position to the pivoted position and vice versa are linear, where in particular the mechanical means are held positively or nonpositively in the operating position.

Additional advantages and embodiments of the invention can be derived from the description of the inventive embodiments in conjunction with the drawings.

DESCRIPTION OF THE INVENTION

Figure 1:
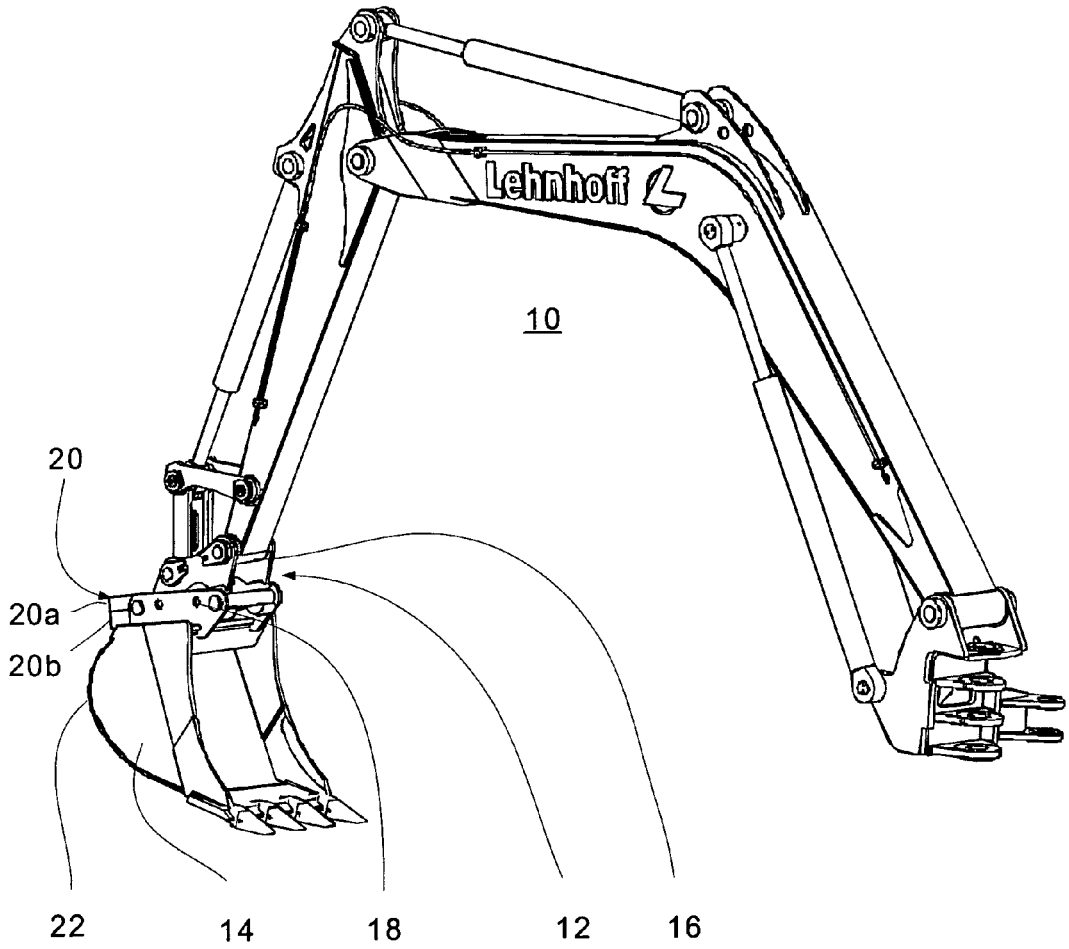
FIG. 1 shows a perspective view of a quick-change device with a quick changer and an adapter, where the quick changer is connected to an excavator arm and the adapter to a sorting bucket.
Figure 2:
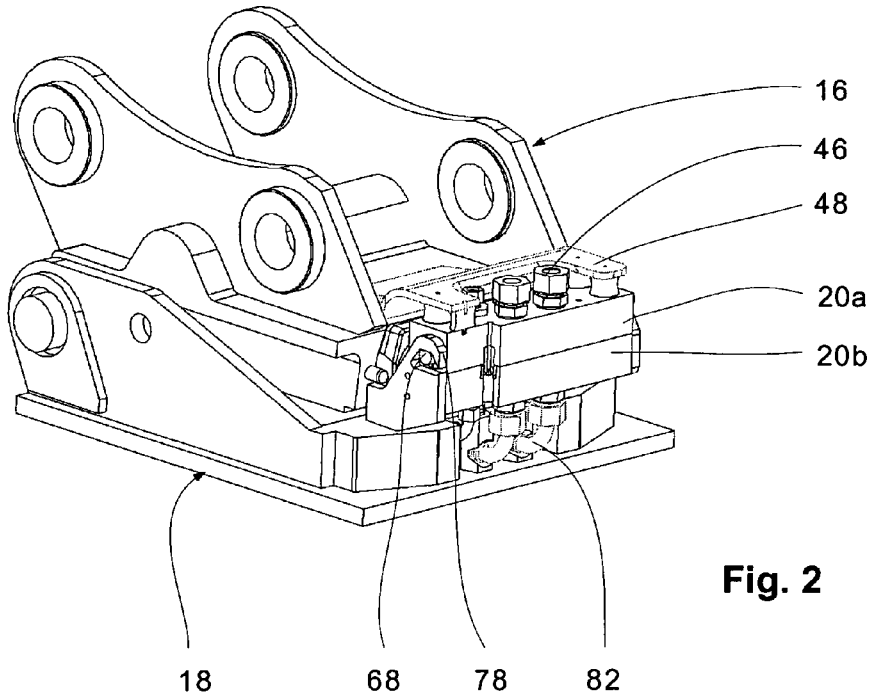
FIG. 2 shows a perspective view of the quick-change device of a first embodiment of the invention in the coupled state.

FIG. 1 shows the arm 10 of a working machine, namely, an earth-moving machine, such as an excavator, in perspective. At the end of the arm 10 there is a quick-change device 12, which is connected in turn to a conventional sorting bucket 14.

The quick-change device 12 consists of a quick changer 16 connected to the arm 10 and an adapter 18. The adapter 18 is permanently mounted on the bucket 14. Through the use of the quick-change device 12, the arm 10 can be connected to various tools such as the illustrated sorting bucket 14 by way of the adapter. Instead of the sorting bucket 14 mentioned above, it is also possible to use other tools, especially those which are hydraulically operated, such as hydraulic hammers, hydraulic shears, etc.

These tools are driven by a hydraulic drive, which is powered by the working machine. For this purpose, the quick-change device 12 has a hydraulic coupling 20. The tool, in this case the bucket 14, is connected to the hydraulic system of the earth-moving machine by way of the hydraulic coupling 20. For certain applications, the bucket 14 is provided with a rear wall 22, which can be opened hydraulically. The rear wall 22 is opened and closed by a hydraulic drive (not shown), integrated into the bucket 14. The hydraulic drive is connected to the hydraulic system of the earth-moving machine by the hydraulic coupling 20.

Figure 3:
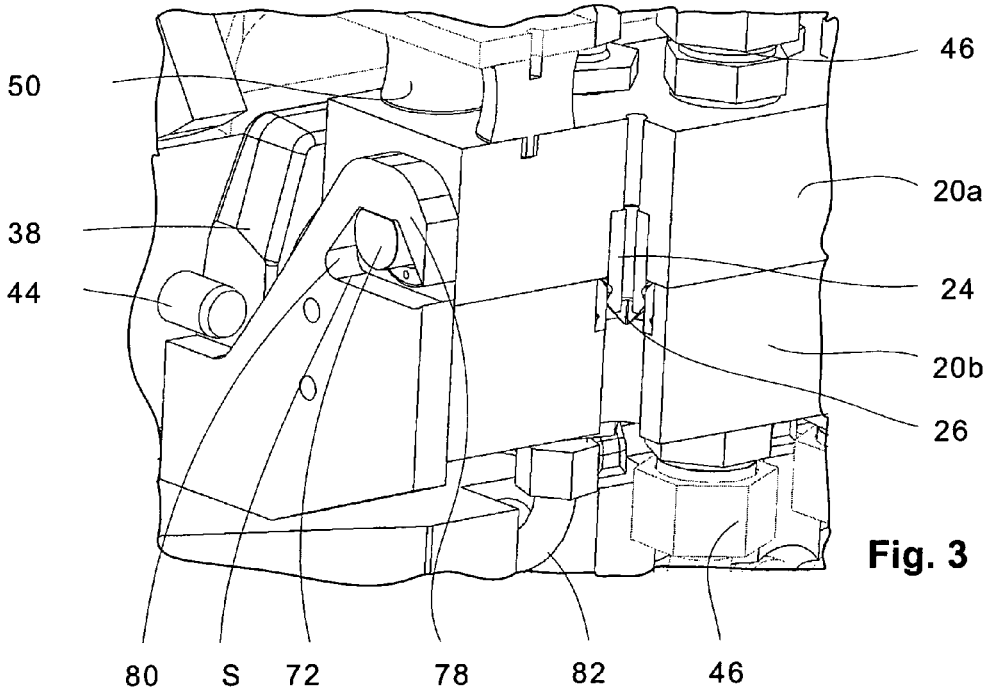
FIG. 3 shows an enlarged, partial, cross-sectional, perspective view of the embodiment of FIG. 2.
Figure 4:
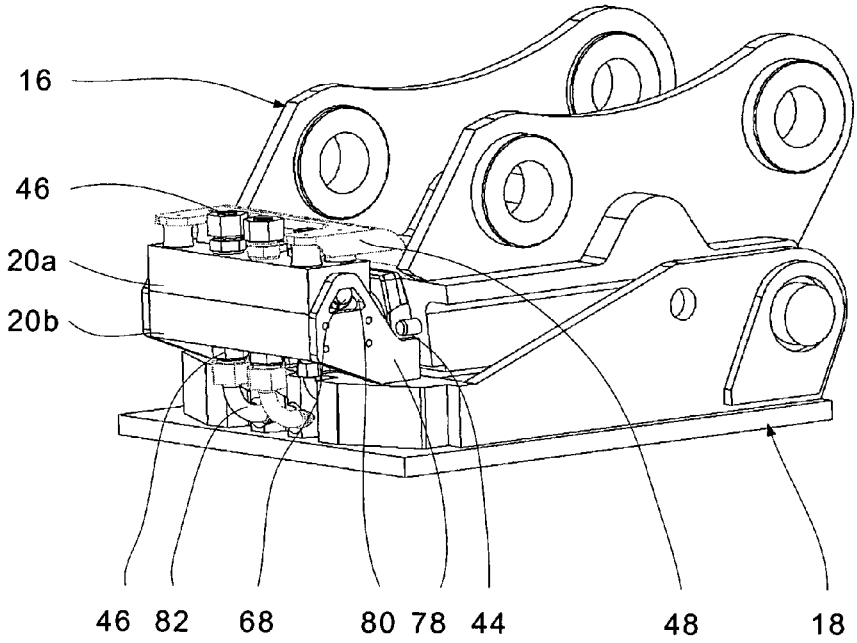
FIG. 4 shows a perspective view of another embodiment of the invention.
Figure 5:
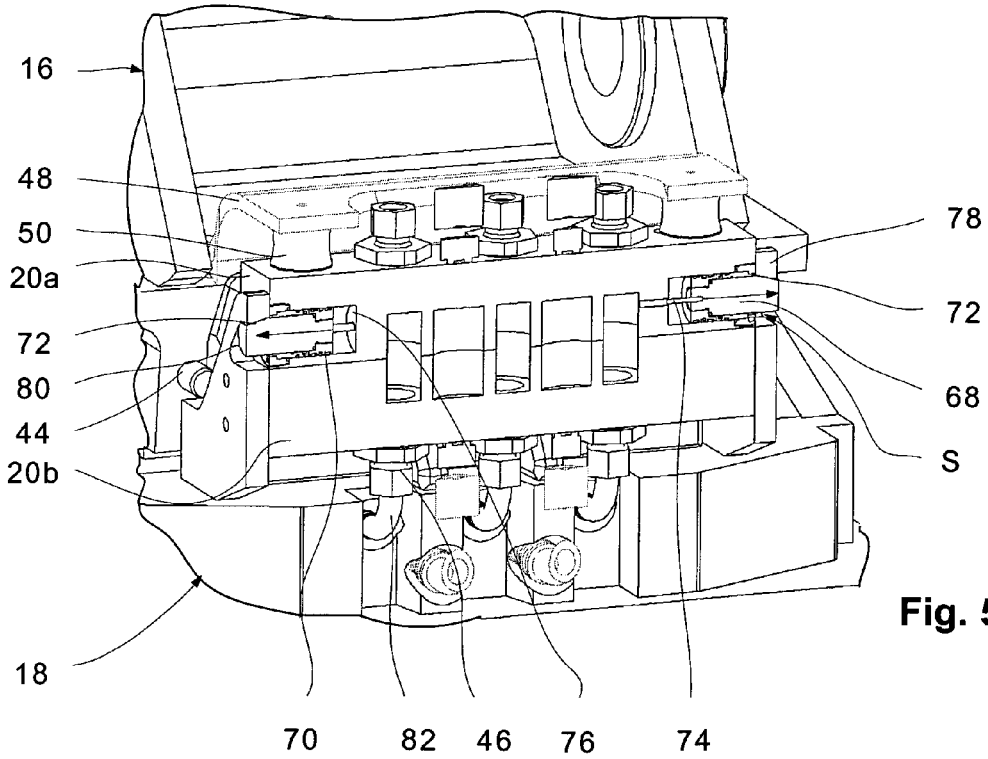
FIG. 5 shows an enlarged, partial, cross-sectional, perspective view of part of FIG. 4.

The hydraulic coupling 20 has an upper coupling block 20*a* and a lower coupling block 20*b*. The cooperating contact surfaces between the two coupling blocks 20*a*, 20*b* are flat. Hydraulic valves, centering pins 24 (see FIGS. 3 and 4), and cleaning nozzles 26, which are integrated into the centering pins to clean the hydraulic coupling, are introduced into these contact surfaces.

The adapter 18 of the quick-change device 12 comprises a base plate 28, at one end of which a locking block 30 is provided, and at the end of the plate opposite the locking block 30, there is a pivot axis 34, which is held in place by means of fastening brackets 32. The locking block 30 has a clamping surface 36 on the side facing the pivot axis 34. This surface slants at an angle of 3-35°, preferably of 5-15°, to a surface perpendicular to the base surface of the adapter 18.

The locking block 30 is also provided with two parallel conical openings 38, which are arranged next to each other a certain distance apart and which are conical in longitudinal cross section. Each conical opening 38 is assigned to a locking bar 40 of the quick changer 16, which can be pushed into the conical opening.

The forward end of the locking bar 40 is designed as a conical tip 40*a*.

A suitable cone angle is chosen for the conical openings 38 bounded by the conical lateral surfaces. In the exemplary embodiment illustrated here, this angle is in the range of 5-15°.

The quick changer 16 has claws (not shown) on the side assigned to the pivot axis 34 of the adapter 18. These claws grip the pivot axis 34.

The end surface of the quick changer 16 assigned to the clamping surface 36 of the adapter has an abutment surface 42, which slants at an angle of preferably 5-15° to the perpendicular—corresponding to the angle of the clamping surface 36—and also has two openings, through each of which one of the locking bars 40, which can be driven longitudinally through the quick changer 16, can pass.

Centering elements are provided for the purpose of lateral centering—the first primary orientation—when the quick changer 16 is lowered onto the adapter 18. The centering elements assigned to the quick changer 16 are designed as centering pins 44, which are arranged laterally next to the abutment surface 42 of the quick changer 16. The centering pins 44 cooperate with the lateral surfaces of the locking block 30 of the adapter 18.

The adapter 18 also has centering elements which act in cooperation with the pivot axis 34 to center the quick changer 16 and the adapter 18 with respect to each other in the longitudinal direction of the clamping surface 36—the second primary orientation. When the quick changer 16 is lowered onto the adapter 18, the clamping surface 36 and the abutment surface 42 ensure in cooperation with the pivot axis 34 that the quick changer 16 and thus the sliding locking bars 40 of the quick changer 16 are aligned with the conical openings 48 and thus centered. The process of engaging the locking bars 40 of the quick changer 16 in the conical openings 38 in the adapter can thus take place without difficulty.

For the rest of the details concerning the function of the quick-change device, reference is made to EP 0 0569 026 A1 of the same applicant, the entire disclosure of which is to be considered part of the content of the present invention, and which is incorporated herein by reference hereto.

At the free end of the adapter 18, the lower coupling block 20*b* is rigidly connected to the locking block 30 by brackets. Hydraulic outlets 46 are provided underneath the free end of the lower coupling block 20*b*. The locking block 30 is for this purpose offset in the inward direction with respect to the lower coupling block 20*b* and the hydraulic outlets 46, so that the hydraulic outlets 46 can be easily connected to the hydraulic hoses/hydraulic lines 82.

The upper coupling block 20*a* is connected to the quick changer 16 by a yoke with two arms 48. Damping elements 50 are inserted between the upper coupling block 20*a* and the arms 48, so that the upper coupling block 20*a* is supported in a floating fashion. Alternatively, the lower coupling block 20*b* can be supported in floating fashion by way of damping elements, and the upper coupling block 20*a* can be mounted directly on the yoke, i.e., on the arms 48. In the embodiments shown in the figures, however, only the upper coupling block 20*a* is supported in floating fashion, because the alternative embodiment could be easily reproduced by any man of the art.

The floating support makes it easy to compensate for manufacturing tolerances. In addition, the upper coupling block 20*a* can, as a result, be easily centered on the lower coupling block 20*b* and properly aligned. The centering pin 24 with the cleaning nozzle 26 is used for this purpose.

FIGS. 2-5 show an embodiment of the invention. In the upper coupling block 20*a*, an actuating pin 68 is supported in a sleeve 70. The actuating pin 68 is hydraulically driven, is cylindrical in design, and is wedge-shaped at its forward end 72.

The lower coupling block 20*b* is screwed laterally to the bracket 78, which is rigidly connected to the adapter 18. The bracket 78 has an opening 80 for the wedge 72 of the actuating pin 68. On the side facing the wedge 72, the opening 80 in the bracket 78 is adapted to the shape of the wedge 72 and is therefore also wedge-shaped, widening in the direction toward the coupling block 20*a*. A bracket 78 is mounted on each side of the lower coupling block 20*b*, and an actuating pin 68 is provided on each side of the upper coupling block 20*a* to engage in the associated bracket. The centering pins 24 with the cleaning nozzles 26 can be seen in the partial cross section.

FIGS. 2-5 also show that the hydraulic couplings 46 are connected to hydraulic lines 82, which are routed in turn through the adapter 18 to the tool (not shown), such as the sorting bucket 14.

The wedge-shaped opening 80 in the bracket 78 is designed as a through-opening for the actuating pin 68. After the actuating pin 68 has moved into the wedge-shaped opening 80, the actuating pin 68 has play S in the downward direction, which prevents the actuating pin 68 from jamming in the wedge-shaped opening no matter what the circumstances, especially after the occurrence of wear.

FIGS. 2-5 show an embodiment with a double-acting actuating piston 68, that is, an actuating piston 68 which moves hydraulically from the change position, in which the quick-change device 12, consisting of the quick-changer 16 mounted on the excavator arm 10 and one of the various possible adapters 18 connected to the tool 14, is used to change from one tool to another, to the operating position, in which the quick changer 16 is rigidly connected to an adapter 18 and the hydraulic coupling 20 is coupled. The movement in the opposite direction also takes place hydraulically by application of an appropriate pressure on the piston from the other side.

Alternatively, a single-acting hydraulic piston (not shown) can be provided, in which the actuating piston 68 is moved by the application of an appropriate hydraulic pressure on only one side of the actuating piston 68. To move the piston in the opposite direction, a spring is used, which is pretensioned when in the operating position and which, upon deactivation of the hydraulic force acting on the actuating piston 68, pushes the piston back into the change position. These types of designs are known, and therefore there is no need for a detailed description.

The actuating piston 68, in cooperation with the opening 80 in the bracket 78, holds the coupling blocks 20*a*, 20*b* tightly together during operation. The hydraulic coupling 20 is connected and also disconnected almost at the same time that the quick changer 16 is connected to and disconnected from the adapter 18. When the quick changer 16 is locked to the adapter, the actuating pin 68 travels simultaneously into the opening 80. Unlocking takes place in an analogous manner. So that the locking bar 40 and the actuating pin 68 move almost simultaneously, they have a common drive unit.

The locking bar 40 and the actuating pin 68, furthermore, travel in a common plane, which also includes the pivot axis 34. As a result, the quick-change device acquires a compact design very advantageous for operation.

According to this embodiment, the quick changer 16 can pivot around the pivot axis 34. When the locking bar 40 of the quick changer is moving to lock the quick-change device 12 in position, it moves in a first direction perpendicular to the pivot axis 34. The coupling movement—the second direction—of the hydraulic coupling 20 takes place essentially perpendicular to the first direction and in this case also perpendicular to the pivot axis 34. The movement of the pin 60 from the change position to the operating position takes place in linear fashion in a third direction, which is perpendicular to the first and second directions. This third direction is parallel to the pivot axis 34.

Figure 6:
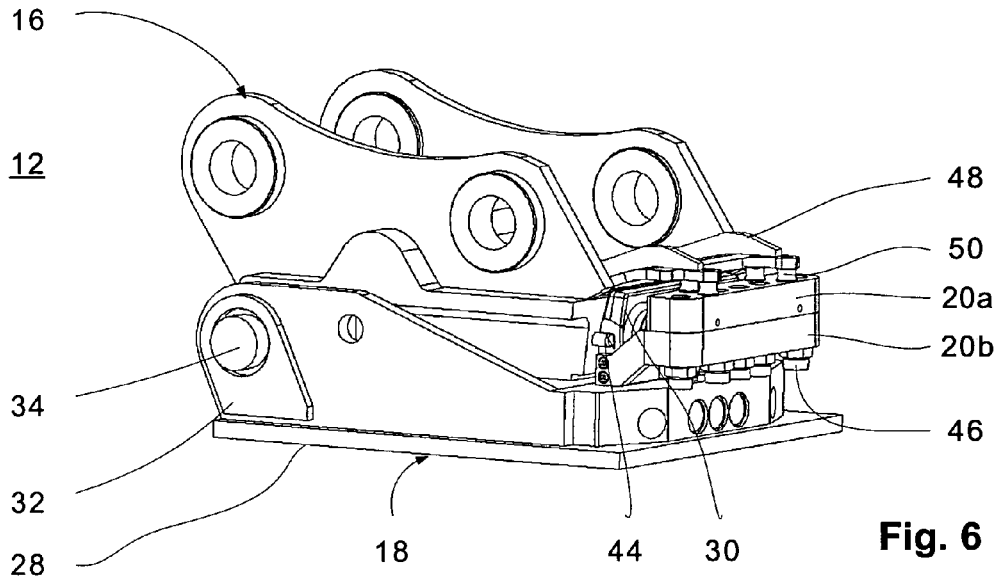
FIG. 6 shows a perspective diagram of another embodiment of the invention.
Figure 7:
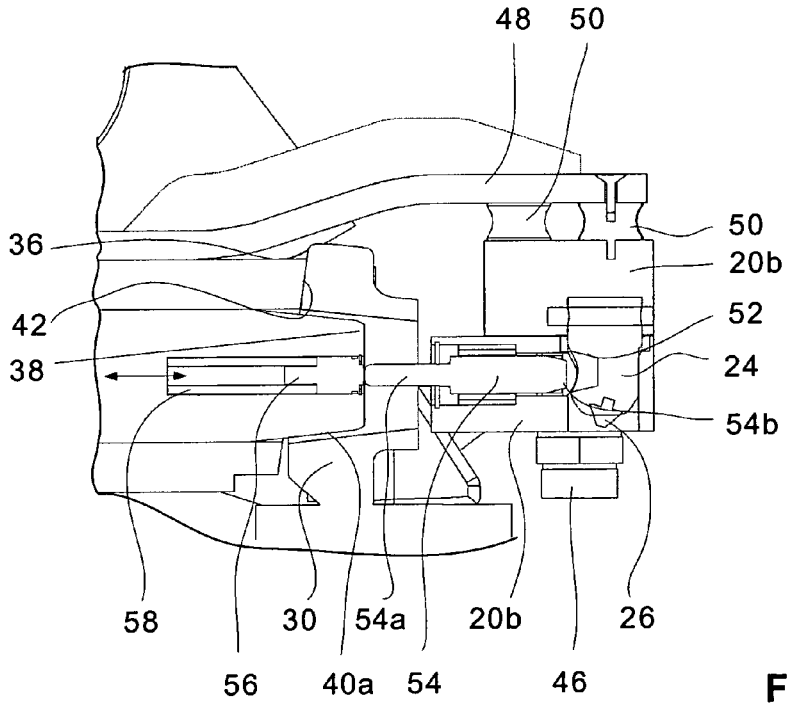
FIG. 7 shows an enlarged, partial, longitudinal cross section through FIG. 6.

FIGS. 6 and 7 show another embodiment. Each centering pin 24 is provided with a conical receptacle 52 facing the quick changer 16. The receptacle cooperates with the conical tip of a clamping pin 54 supported with freedom to slide back and forth in the lower coupling block 20*b*.

The clamping pin 54 is provided with a rear stop stud 54*a*, which cooperates with a plunger 56 inside the locking bar 40 of the quick changer 16. The plunger 56 cooperates with a spring 58 in such a way that, when the plunger 56 is pushed in, the spring 58 is put under tension.

When the claws of the quick changer 16 are placed on the adapter 18 and the quick changer is pivoted around the pivot axis 34, it centers itself as described above, so that the locking bars 40 are aligned with the conical openings 38. In this position, the upper coupling block 20*a* lies on the lower coupling block 20*b*. The locking bars 40 now move into the conical openings 38 and clamp the quick changer 16 to the adapter 18 and clamp the coupling blocks 20*a*, 20*b* to each other. As a result of this clamping operation, the coupling blocks 20*a*, 20*b* are coupled to each other.

When the locking bar 40 travels inward, the plunger 56 inside the locking bar 40 strikes the stop stud 54*a* of the clamping pin 54 and moves this pin away from the locking bar 40 against the force of the spring 58 and toward the conical receptacle 52 in the centering pin 24. In analogy to the way in which the quick-changer 16 is clamped to the adapter 18 by the cooperation between the conical ends 40*a* of the locking bars 40 and the conical openings 38 in the adapter 18, now the upper coupling block 20*a* is also clamped to the lower coupling block 20*b*, where the conical end 54*b* of the clamping pin 54 has traveled into the conical receptacle 52.

The spring 58 serves to compensate for the overstroke which the locking bar 40 makes versus the clamping pin 54. The spring 58 is not compressed until the conical end 54*b* of the clamping pin 54 is resting completely inside the conical receptacle 52 and is thus holding the two coupling blocks/valve blocks 20*a*, 20*b* together. As a result, the coupling blocks 20*a*, 20*b* are protected even at this early point from spreading forces. The locking bars 40 are still not in contact with the walls of the conical openings 38 at this point but continue to move until they are fully engaged in the openings. This results in the previously mentioned overstroke, and the spring 58 is now put under tension. This guarantees that, after the quick changer 16 has become worn and thus rotates farther around the pivot axis 34 and thus the locking bars 40 gain the ability to seat themselves more deeply in the conical openings 38, the coupling blocks 20*a*, 20*b* will always be reliably clamped together even before the locking bars are fully engaged. The clamping pins, which are, after all, already resting in the conical receptacles 52, do not interfere in any way with the movement of the locking bars 40.

After the conical end 54*b* of the clamping pin 54 enters the conical receptacle 52, the conical end 54*b* of the clamping pin 54 rests flat on the walls of the conical receptacle 52 over a circumferential angle of up to a maximum of 180°. The partial surfaces of the clamping pin 54 making up the rest of the circumference to 360° create a bearing play S, which prevents the clamping pin 54 from jamming in the conical receptacle 52 under any circumstances, not even after the occurrence of wear.

Figure 8:
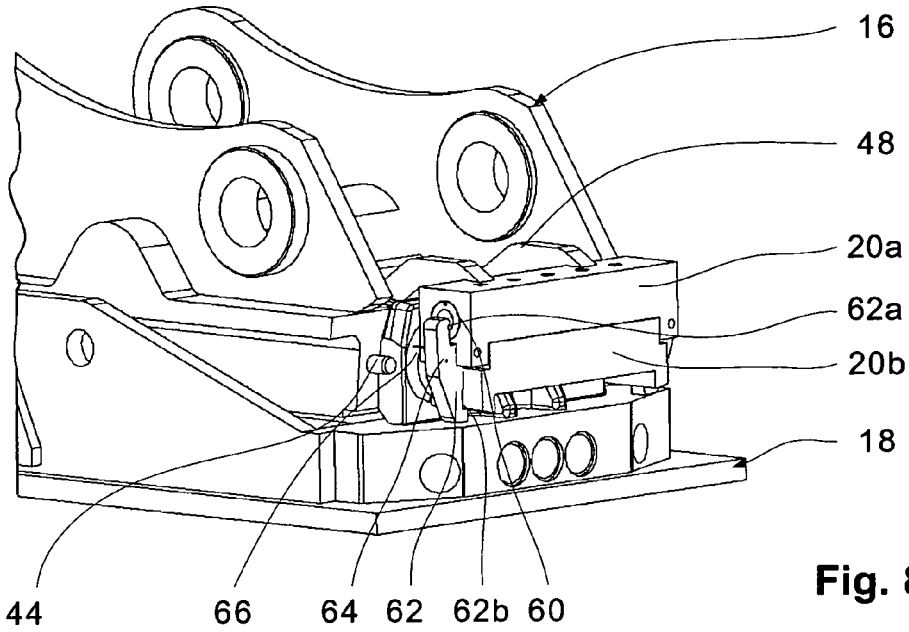
FIG. 8 shows a perspective diagram of another embodiment of the invention.
Figure 9:
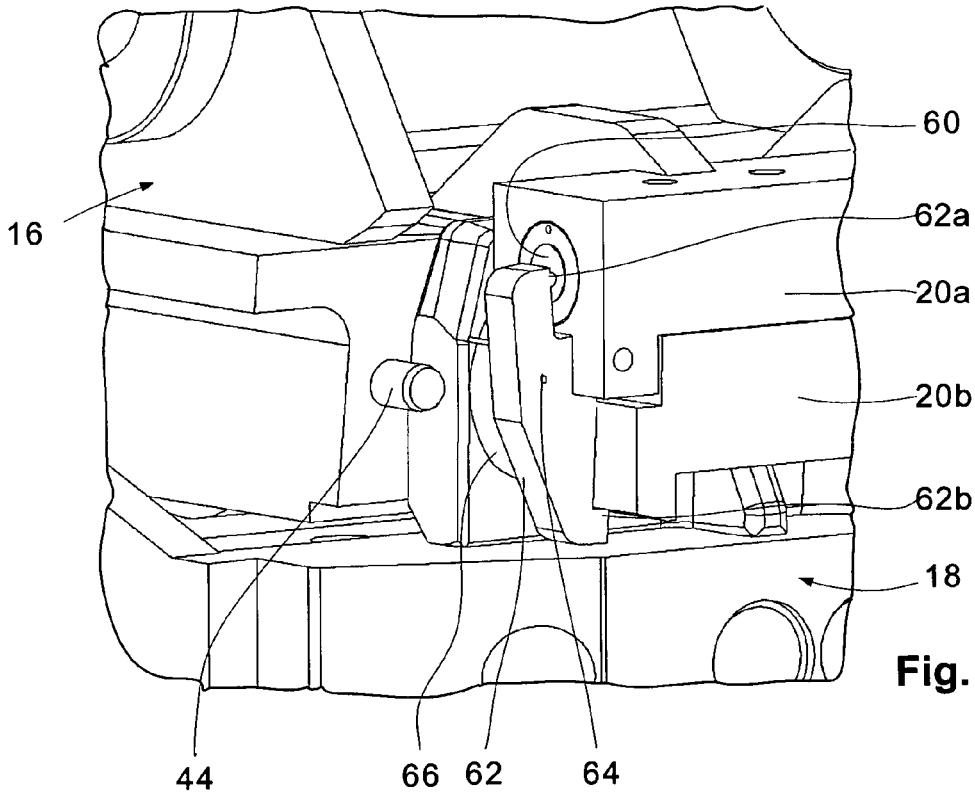
FIG. 9 shows an enlarged, perspective view of FIG. 8.

FIGS. 8 and 9 show another embodiment of the invention. The upper coupling block 20*a* is provided with a hydraulically actuated actuating bar 60, which is capable of traveling laterally outward and thus against the force of a spring (not shown). A rocker 62, which is supported more-or-less at its midpoint on the upper coupling block 20*a* so that it is free to rock back and forth, cooperates with the actuating bar 60. At one end, the rocker 62 has a projection 62*a*, which cooperates with the actuating bar 60, and at the other end it has a claw 62*b*, which grips the lower coupling block 20*b*. The claw 62*b* is beveled to match the associated lower abutment surface of the lower coupling block 20*b*. Jamming is prevented by the cooperation between these two slanted surfaces, and the pressure exerted by way of the actuating bar 60 on the rocker 62 makes it possible to hold the coupling blocks 20*a*, 20*b* non-positively together. The rocker 62 is supported rotatably on a pivot pin 64 and is pretensioned by a torsion spring (not shown) in such a way that the rocker 62 releases the lower coupling block 20*b* when the actuating bolt 60 travels inward.

The pivot pin 64 is connected to the upper coupling block 20*a* and thus to the quick changer 16 by a retaining arm 66. In this way the coupling blocks 20*a*, 20*b* are held together during operation, that is, in the coupled state, by the rocker 62, the pivot pin 64, the retaining arm 66, and the claw 62*b* in cooperation with the beveled abutment surface of the lower coupling block 20*b* under the hydrostatic force acting on the actuating bar 60. The design just described is provided on both sides of the coupling blocks 20*a*, 20*b*.

The spreading forces which occur can thus be transmitted between the upper and lower coupling blocks 20*a*, 20*b* via the rocker 62 on each side. The hydrostatic force being applied holds the actuating bar 60 in question in the retaining position. When the hydrostatic force is deactivated, the spring in the upper coupling block 20*a* assigned to the actuating bar 60 in question moves the bar inward, so that the corresponding rocker 62 can pivot under the action of the torsion spring (not shown) connected to the pivot pin 64 far enough to release the lower coupling block 20*b* and thus to allow the quick-change device 12 to be opened.

All of the previously described embodiments of the invention are symmetric to the longitudinal center axis of the quick changer 16, so that, for example, two sets of the mechanical retaining means for holding the coupling blocks 20*a*, 20*b* together are provided, one on each side. Alternatively, the mechanical retaining means can be arranged differently, or all of them can be arranged at the front of the quick-change device.

The embodiments shown in the drawing comprise a quick-change system according to the quick-change device disclosed in WO 2005/093172 A1.

The invention is characterized by the simplicity with which the spreading forces can be counteracted by mechanical means. Additional forces/pressures, however, are also required to actuate and to hold the mechanical means, such as the bars, in position. When the hydraulic pressure is turned off, the upper and lower coupling blocks 20*a*, 20*b* are released, and the quick changer 12 can be opened.

Because the bars travel in straight lines and are arranged essentially on the same plane as that which also holds the pivot axis, a compact design is achieved.

LIST OF REFERENCE NUMBERS

10 arm
12 quick-change device
14 bucket
16 quick changer
18 adapter
20 hydraulic coupling
20*a* upper coupling block
20*b* lower coupling block
22 rear wall
24 centering pins
26 cleaning nozzle
28 base plate of the adapter
30 locking block
32 fastening bracket
34 pivot axis
36 clamping surface
38 conical opening
40 locking bar
40*a* conical end
42 abutment surface
44 pins
46 hydraulic connections
48 arm/yoke
50 damping element
52 conical receptacle
54 clamping bar
54*a* stop stud
54*b* conical end
56 plunger
58 spring
60 actuating bar
62 rocker
62*a* projection
62*b* claw
64 pivot pin
66 retaining arm
68 actuating pin
70 sleeve
72 forward end of the actuating pin/wedge
74 piston rod
76 hydraulic piston
78 bracket
80 opening
82 hydraulic line

The invention claimed is:

1. Quick-change device (12), comprising:
a quick changer (16) attached to a working machine;
a tool (14);
an interlocking mechanism;
a hydraulic system on said working machine;
an adapter (18) lockable to said quick changer (16), said adapter connected to a tool (14);
a hydraulic coupling (20) for establishing a hydraulic connection between said hydraulic system present on said working machine and said hydraulic system of said tool (14);
said hydraulic coupling (20) consists of a first coupling part (20*a*) and a second coupling part (20*b*), said coupling parts (20*a*, 20*b*) being held in an operating position relative to each other;
said first coupling part (20*a*) and said second coupling part (20*b*) cooperate with at least mechanical retaining means (68, 78, 80), said mechanical retaining means are separate from said interlocking mechanism; and,
said coupling parts (20*a*, 20*b*) are held together nonpositively in the operating position by the mechanical retaining means (68, 78, 80).

2. Quick-change device according to claim 1, wherein at least parts of said mechanical retaining means (68, 78, 80) can move from a change position to an operating position and/or from said operating position to said change position under the action of a drive unit.

3. Quick-change device according to claim 2, wherein said drive unit for moving said mechanical retaining means (68, 78, 80) from said change position to the operating position and/or out of the operating position into said change position is a hydraulic, pneumatic, electrical, mechanical, and/or magnetic drive unit.

4. Quick-change device according to claim 1, wherein said first coupling part is designed as a coupling block (20*a*) connected to said quick changer (16), said second coupling part is designed as a coupling block (20*b*) connected to said adapter (18), and, said coupling blocks (20*a*, 20*b*) comprises at least one part of a hydraulic coupling valve which cooperates with another valve part on said other block.

5. Quick-change device according to claim 4, wherein said drive unit for moving said mechanical retaining means (68, 78, 80) from said operating position to said change position is different from the drive unit for moving said mechanical retaining means (68, 78, 80) from said change position to said operating position and is in particular a force-storing device such as a spring (70).

6. Quick-change device according to claim 5, wherein said drive unit for moving said mechanical retaining means (68, 78, 80) from said change position to said operating position is designed as a fluidic, especially a hydraulic, drive unit with a single-acting piston.

7. Quick-change device according to claim 1, wherein said drive unit which moves said mechanical retaining means (68, 78, 80) from said change position to said operating position is the same as said drive unit which moves said retaining means from said operating position to said change position and is designed in particular as a fluidic, preferably hydraulic, drive unit with a double-acting piston.

8. Quick-change device according to claim 1, wherein said mechanical retaining means (68, 78, 80) comprises a first part connected to said quick changer (16) and a second part connected to said adapter (18).

9. Quick-change device according to claim 8, wherein said first part is a pin (68), and said second part is a receptacle (80)

for said pin (68), where said pin (68), when in said operating position, is held in place by a force acting in the direction toward said operating position.

10. Quick-change device according to claim 8, wherein that the force is produced by said drive unit for moving said mechanical retaining means (68, 78, 80) from said change position to said operating position and/or vice versa.

11. Quick-change device according to claim 9, wherein said pin includes a forward end, said forward end of said pin (68), is a wedge-like in shape, and in said receptacle (80) has a corresponding shape.

12. Quick-change device according to claim 11, wherein said pin (68) is a cylindrical bolt with a conical forward end.

13. Quick-change device according to claim 12, wherein said pin (68), when in said operating position, has bearing play (S) in the downward direction in said receptacle (80).

14. Quick-change device according to claim 13, wherein said pin (68) of said retaining means includes a forward area of said locking bar (80), said receptacle includes conical lateral cooperating surfaces which correspond to each other and which extend over a circumferential angle of up to 180° , said receptacle further includes steep circumferential surfaces comprising the remainder of the circumference to 360° and said steep circumferential surfaces cooperate with said associated circumferential areas of said forward area of said pin (68) to create said predetermined bearing play (S).

15. Quick-change device according to claim 8, wherein said first part of said mechanical retaining means (68, 78, 80) is designed as a rocker (62) with a locking claw (62*b*), and said second part of said mechanical retaining means is designed as an abutment, where said claw (62*b*) and the abutment surface have a wedge-like shape.

16. Quick-change device according to claim 1, wherein said movement of the mechanical means (68, 78, 80) from said change position to said pivoted position and vice versa is linear.

17. Quick-change device according to claim 1, wherein said quick-changer (16) is able to pivot around a pivot axis (34) and comprises at least one locking bar (40), said locking bar moves in a straight line; said straight line and said pivot axis form a working plane.

18. Quick-change device according to claim 17, wherein said locking bar (40) is able to move along a first straight line perpendicular to said pivot axis (34), and, said coupling movement of said hydraulic coupling (20) proceeds along a second straight line, essentially perpendicular to said first straight line.

19. Quick-change device according to claim 18, wherein a second straight line is perpendicular to said pivot axis (34).

20. Quick-change device according to claim 17, wherein said bar (60) moves from said change position to said operating position along a third straight line.

21. Quick-change device according to claim 20, wherein said third straight line lies in said working plane and in particular is perpendicular to said first and second straight lines.

22. Quick-change device according to claim 21, wherein said third straight line is parallel to said pivot axis (34).

23. Quick-change device, comprising:

a quick changer (16) attached to a working machine;

a tool (14);

an interlocking mechanism;

a hydraulic system on said working machine;

an adapter (18) lockable to said quick changer (16), said adapter connected to a tool (14);

a hydraulic coupling (20) for establishing a hydraulic connection between said hydraulic system present on said working machine and said hydraulic system of said tool (14);

said hydraulic coupling (20) consists of a first coupling part (20*a*) and a second coupling part (20*b*), said coupling parts (20*a*, 20*b*) being held in an operating position relative to each other;

said first coupling part (20*a*) and said second coupling part (20*b*) cooperate with at pin 68, bracket 78, and opening 80, said pin 68, bracket 78 and opening 80 are separate from said interlocking mechanism; and, said movement of said pin 68, bracket 78 and opening 80 from said change position to said pivoted position and vice versa is linear.

24. Quick-change device according to claim 23, wherein said pin 68, bracket 78 and opening 80 are held nonpositively or positively in said operating position.

25. Quick-change device (12), comprising a quick changer (16) attached to a working machine;

a tool (14);

an interlocking mechanism;

a hydraulic system on said working machine;

an adapter (18) lockable to said quick changer (16), said adapter connected to a tool (14);

a hydraulic coupling (20) for establishing a hydraulic connection between said hydraulic system present on said working machine and the hydraulic system of said tool (14);

said hydraulic coupling (20) consists of a first coupling part (20*a*) and a second coupling part (20*b*), said coupling parts (20*a*, 20*b*) being held in an operating position relative to each other;

said first coupling part (20*a*) and said second coupling part (20*b*) cooperate with at least mechanical retaining means (68, 78, 80), said mechanical retaining means are separate from said interlocking mechanism;

said movement of said mechanical means (68, 78, 80) from said change position to said pivoted position and vice versa is linear;

a pivot axis (34);

said quick-changer (16) is able to pivot around a pivot axis (34) and comprises at least one locking bar (40), the straight line along which it moves cooperating with the pivot axis to form a working plane;

said locking bar (40) is able to move along a first straight line perpendicular to the pivot axis (34), and, said coupling movement of said hydraulic coupling (20) proceeds along a second straight line, essentially perpendicular to said first straight line;

a second straight line is perpendicular to said pivot axis (34);

movement of said bar (60) from said change position to said operating position proceeds along a third straight line; and, said third straight line lies in said working plane and in particular is perpendicular to said first and second straight lines.

* * * * *